US010576324B2

(12) United States Patent
Dolcetti

(10) Patent No.: US 10,576,324 B2
(45) Date of Patent: Mar. 3, 2020

(54) EXOSKELETON SYSTEM

(71) Applicant: Joseph Cleary Dolcetti, Kuala Lumpur (MY)

(72) Inventor: Joseph Cleary Dolcetti, Kuala Lumpur (MY)

( * ) Notice: Subject to any disclaimer, the term of this patent is extended or adjusted under 35 U.S.C. 154(b) by 107 days.

(21) Appl. No.: 14/986,670

(22) Filed: Jan. 2, 2016

(65) Prior Publication Data

US 2016/0113339 A1 Apr. 28, 2016

Related U.S. Application Data

(63) Continuation-in-part of application No. 14/665,660, filed on Mar. 23, 2015, now abandoned, which is a continuation-in-part of application No. 13/576,034, filed as application No. PCT/MY2011/000011 on Jan. 28, 2011, now abandoned.

(30) Foreign Application Priority Data

Feb. 3, 2010 (MY) ..... PI 2010000514

(51) Int. Cl.

| | |
|---|---|
| ***A63B 21/00*** | (2006.01) |
| ***A63B 21/065*** | (2006.01) |
| ***A41D 13/00*** | (2006.01) |
| *A63B 71/12* | (2006.01) |
| *A63B 71/00* | (2006.01) |

(52) U.S. Cl.

CPC ..... *A63B 21/065* (2013.01); *A41D 13/0015* (2013.01); *A63B 21/00061* (2013.01); *A63B 21/00065* (2013.01); *A63B 21/4001* (2015.10); *A63B 21/4007* (2015.10); *A63B 21/4011* (2015.10); *A63B 71/0054* (2013.01); *A63B 71/12* (2013.01); *A63B 2225/68* (2013.01); *A63B 2225/685* (2013.01)

(58) Field of Classification Search

CPC ..... A63B 21/4001; A63B 21/00061; A63B 21/00065; A63B 21/065; A63B 71/12; A63B 21/4007; A63B 2225/68; A63B 2225/685; A63B 71/0054; A63B 21/4011; A41D 13/0015

See application file for complete search history.

(56) References Cited

U.S. PATENT DOCUMENTS 4,382,302 A * 5/1983 Watson ..... A63B 21/065 2/102
4,407,497 A * 10/1983 Gracie ..... A63B 21/065 128/DIG. 15
5,010,596 A * 4/1991 Brown ..... A63B 21/065 2/227

(Continued)

*Primary Examiner* — Khaled Annis
(74) *Attorney, Agent, or Firm* — Preston Smirman; Smirman IP Law, PLLC

(57) ABSTRACT

An exoskeleton (100) system comprises at least one garment selected from the group consisting of a shirt or vest (110), short or pants (120), an upper arm sleeve (130), a lower arm sleeve (140), a thigh sleeve (150), and a leg sleeve (160) wherein the garment may be a multilayer construct that comprises an inner layer (201) of nylon material, a middle layer (202) made of neoprene, an outer layer (203) made of plush material; and an article (300) with attached hook and loop fasteners (301) to be mounted onto the garment by securing the hook and loop fasteners (301) onto any spots or locations of the outer layer (203).

4 Claims, 16 Drawing Sheets

(56) References Cited

U.S. PATENT DOCUMENTS

| | | | | |
|---|---|---|---|---|
| 6,807,680 | B2 * | 10/2004 | Sloot | A01K 11/00 119/857 |
| 2002/0010058 | A1 * | 1/2002 | Myrick | A63B 21/065 482/92 |
| 2005/0081277 | A1 * | 4/2005 | Matechen | A41D 13/0156 2/102 |
| 2006/0046913 | A1 * | 3/2006 | Squittieri | A63B 21/4001 482/124 |
| 2006/0172870 | A1 * | 8/2006 | Virji | A63B 21/065 482/105 |
| 2008/0040831 | A1 * | 2/2008 | Nilforushan | A41D 13/0058 2/69 |
| 2008/0201818 | A1 * | 8/2008 | Nilforushan | A41D 13/005 2/69 |
| 2010/0024089 | A1 * | 2/2010 | Turner | A41D 13/05 2/23 |
| 2010/0043123 | A1 * | 2/2010 | Goodhand | A41D 13/0015 2/228 |
| 2010/0319097 | A1 * | 12/2010 | Turner | A41D 13/0587 2/22 |

* cited by examiner

EXOSKELETON SYSTEM

CROSS-REFERENCE TO RELATED APPLICATION

The instant application is a continuation-in-part of U.S. patent application Ser. No. 14/665,660, filed Mar. 23, 2015, which is a continuation-in-part of U.S. patent application Ser. No. 13/576,034, filed Sep. 13, 2012, abandoned, which is a national phase of PCT/MY2011/000011, filed Jan. 28, 2011, and which claims priority to Malaysian Patent Application No. PI 2010000514, filed Feb. 3, 2010, the entire specifications of all of which are expressly incorporated herein by reference.

FIELD OF THE INVENTION

The present invention relates to garments to be worn by a wearer that the garments serve as an exoskeleton. Moreover, the garment has an outer surface which is made of plush material and allows anchorage of useful devices onto the garments with the use of hook and loop fasteners.

BACKGROUND OF THE INVENTION

Various garments have been specially designed for promoting performance and recovery progress of athletes. For example, most performance enhancing garments are loaded up with exogenous weights to be worn by the athlete during the training session. Consequently, this stimulates the generation of body muscles in the athlete as a result of exerting additional force to cope with the exogenous weights. Many of the commercial products available in the market operate on this principle to enhance sport performance in athletes, as well as to promote general fitness for the active person.

United Kingdom Patent No. 2359497 discloses a progressive weighted exercise garment. The disclosure includes a garment panel, a weigh receiving module with pouches for receiving weighted members and securing means to fix the module onto the garment. The receiving module is preferably sewn onto the garment at a predetermined position to minimize possible injury to the wearer and the pouches within are compartments made of pleated sheets.

Exercise apparel with a weight packet is disclosed in U.S. Pat. No. 5,144,694. The disclosed apparel includes a structure for holding at least one weight packet, while the weight packets are plural rows and plural columns of weight members inside a cloth pouch.

Johnson further describes a weighted exercise garment in U.S. Pat. No. 5,553,322 wherein the garment is formed of a one piece resilient flexible material to be snugly fit onto the wearer. Preferably, the disclosed garment includes means for removably carrying weights to be attached onto the front and rear upper panels, as well as the thigh portion of the garment. Correspondingly, complementary releasable fasteners are located at the mentioned panels for mounting of the weights.

A non-exercise activity thermogenesis weight loss garment is disclosed in United States Patent Publication No. 2006/0172870. The garments are sleeves for distal limbs that contain predefined amounts of additional weight loads stitched onto them. By wearing the disclosed garment in daily activities, the garment is supposedly able to increase daily caloric expenditure by the wearer.

However, all the above mentioned devices share a common shortcoming, i.e., they lack the flexibility that allows wearers to customize themselves regarding the body parts to be loaded with the exogenous weights. In more specific terms, the above mentioned devices have predetermined locations fabricated on the garment to be loaded with the exogenous weights. A limitation of this can be, for example, athletes of a particular sport may need neuromuscular or physiological development in only specific parts of the body, pouches or attachment sites for securing the exogenous weights provided on the garment can be redundant if these sites were not in use. On the other hand, lack of attachment sites at certain locations may prohibit exogenous weights to be loaded for training purposes. Moreover, the mentioned devices focus mainly on weight load training solely, while ignoring the fact that protection to the body part is equally important, particularly in sports involving violent physical contact such as soccer or football. The sport performance promoting garment should also offer sufficient protection to the wearer (and preferably serve as an exoskeleton) while it is worn to enhance sports performance and/or general health and fitness.

SUMMARY OF THE INVENTION

The present invention aims to provide an exoskeleton system that may be equipped with a convenient and wearer-friendly anchoring mechanism over its entire outer surface for attachment of various devices. More particularly, the exoskeleton system may have an outer surface fully covered by plush material providing thereon a platform for anchoring different devices designed to perform various tasks during, but not limited to, all types of exercise and movements associated with health, fitness, and sports training and/or protection during high impact activities.

An object of the present invention is to disclose an exoskeleton system that is capable of enhancing recovery progress and overall neuromuscular, physiological and psychological function upon wearing the disclosed system on its own. Specifically, the present invention may be made of materials with good pliability and it is intended to be worn in a generally snug fit fashion. The exoskeleton in its contracting state may apply a compressive force onto a body part that promotes several positive responses including, but not limited to, favorable blood flow, enhanced muscle contraction, improved stabilization and confidence during movement, and a positive thermogenic effect in the specific area(s).

Another object of the present invention is to disclose an exoskeleton system that may allow light to moderate progressive resistance and specific weight load training onto different muscle parts in the body according to the wearer's preference. In more detail, the anchoring mechanism may permit the wearer to attach one or more exogenous weight loads, of any volume, onto one or more specific locations of the body, as long the body part is covered by the exoskeleton system. Consequently, specific muscle parts can be progressively trained as planned by the wearer.

Still another object of the present invention is to offer protection to the wearer. Apart from the fact that the present invention may be made of soft elastic materials with impact absorbing properties, a soft or hardened, shield-like device can also be anchored thereon and used to render additional protection to the wearer.

At least one of the preceding objects is met, in whole or in part, by the present invention, in which one of the embodiments of the present invention may include an exoskeleton system comprising at least one garment selected from the group consisting of a shirt or vest, pants, an upper arm sleeve, a lower arm sleeve, a full arm sleeve, a double arm sleeve, a thigh sleeve, a calf leg sleeve, a full sleeve shirt, and a full- or a partial-body suit, wherein the garment is a multilayer construct that comprises an inner layer of nylon material and an outer layer made of plush material, and an article with attached hook and loop fasteners to be mounted onto the garment by securing the hook and loop fasteners onto any spots or locations of the outer layer.

In a further embodiment, a structurally strong material such as, but not limited to neoprene or polyurethane may be disposed in between the inner layer and the outer layer, thus providing a middle layer thereto.

In another aspect of the present invention, the garment may be perforated with a plurality of through holes for air ventilation.

According to another aspect, the article of the present invention may also allow the attachment to any part of the body covered by the exoskeleton, various useful devices to be used in conjunction with the garments. Representative examples of the devices may include, without limitation, stopwatches, timers, heart rate monitors, pedometers, inertia, motion or acceleration sensors, GPS tracking devices, MP3 devices, and/or the like.

In a further aspect, the article may be one or more exogenous weights to be attached for specific and progressive, light to moderate resistance training. Preferably, the garment may be compressive upon wearing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Other advantages of the present invention will be readily appreciated as the same becomes better understood by reference to the following detailed description when considered in connection with the accompanying drawings wherein.

The same reference numerals refer to the same parts throughout the various Figures.

DETAILED DESCRIPTION OF THE INVENTION

The following description of the preferred embodiment(s) is merely exemplary in nature and is in no way intended to limit the invention, or uses.

The terms such as inner, outer, middle, upper, lower, left, right, smaller, larger, longer, shorter, are used herein for reference purposes only and are not meant to be limiting.

Figure 1:
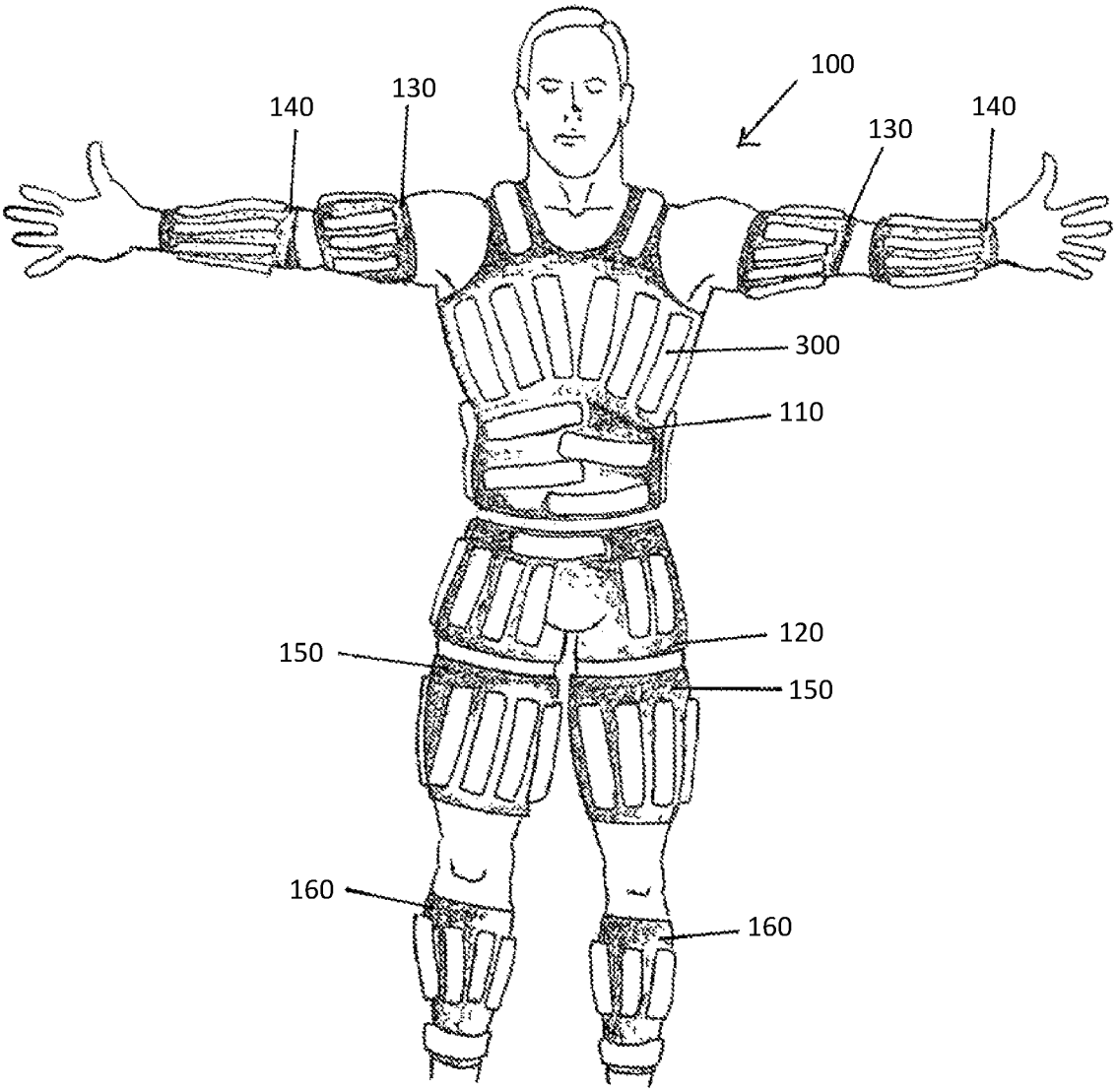
FIG. 1 illustrates a front view of an exemplary exoskeleton system of the present invention, along with a plurality of attached articles, that is being worn by a wearer.
Figure 2:
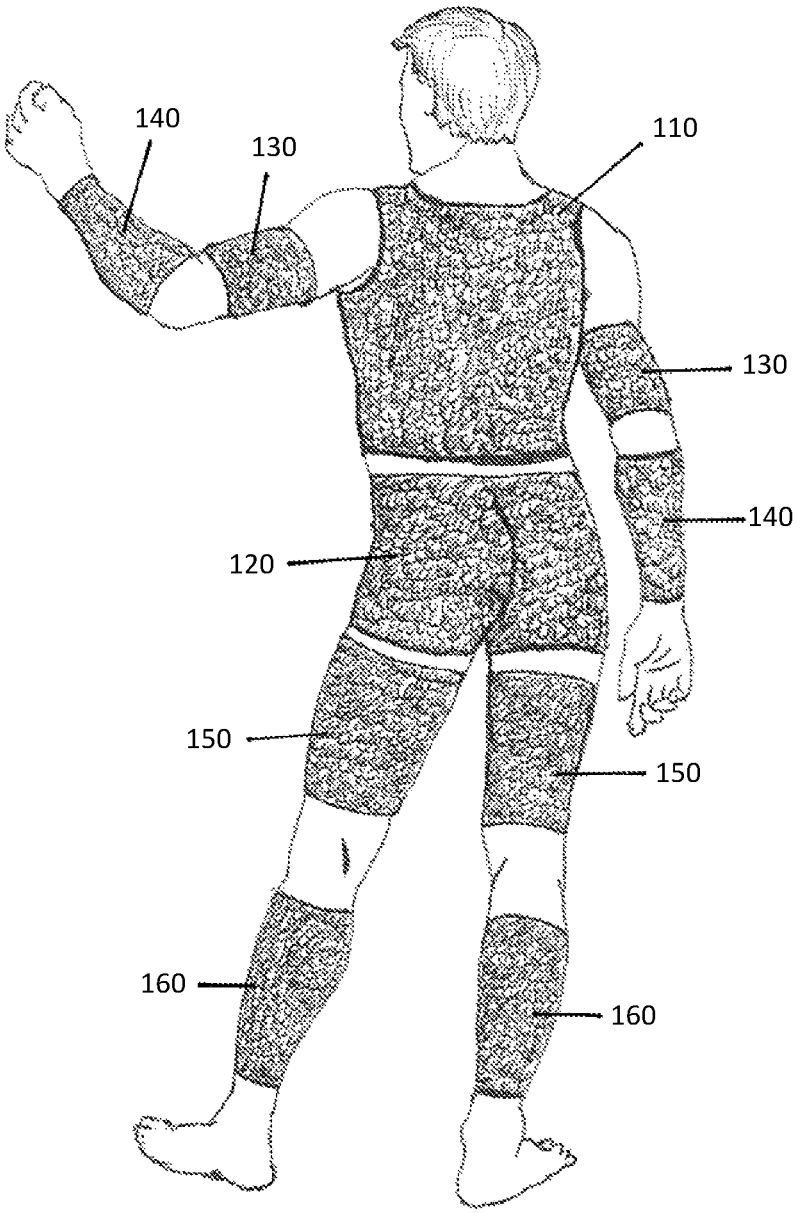
FIG. 2 illustrates aback view of the exoskeleton system depicted in FIG. 1 without any attachment of the articles.
Figure 12:
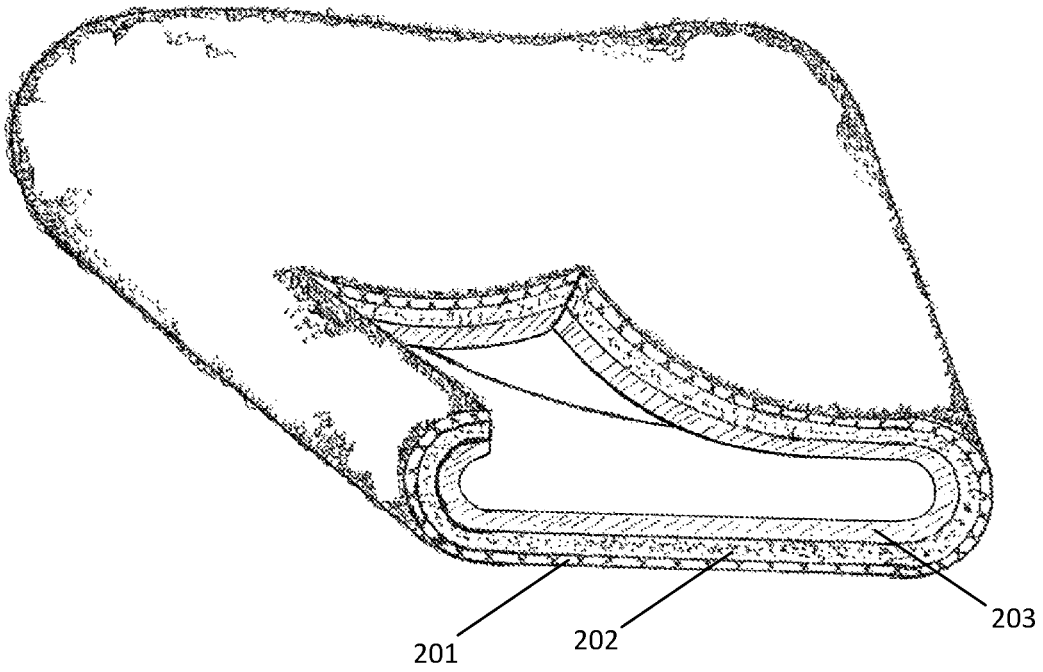
FIG. 12 illustrates a multilayer construct used to fabricate the sleeve of the exoskeleton system depicted in FIG. 9.
Figure 13:
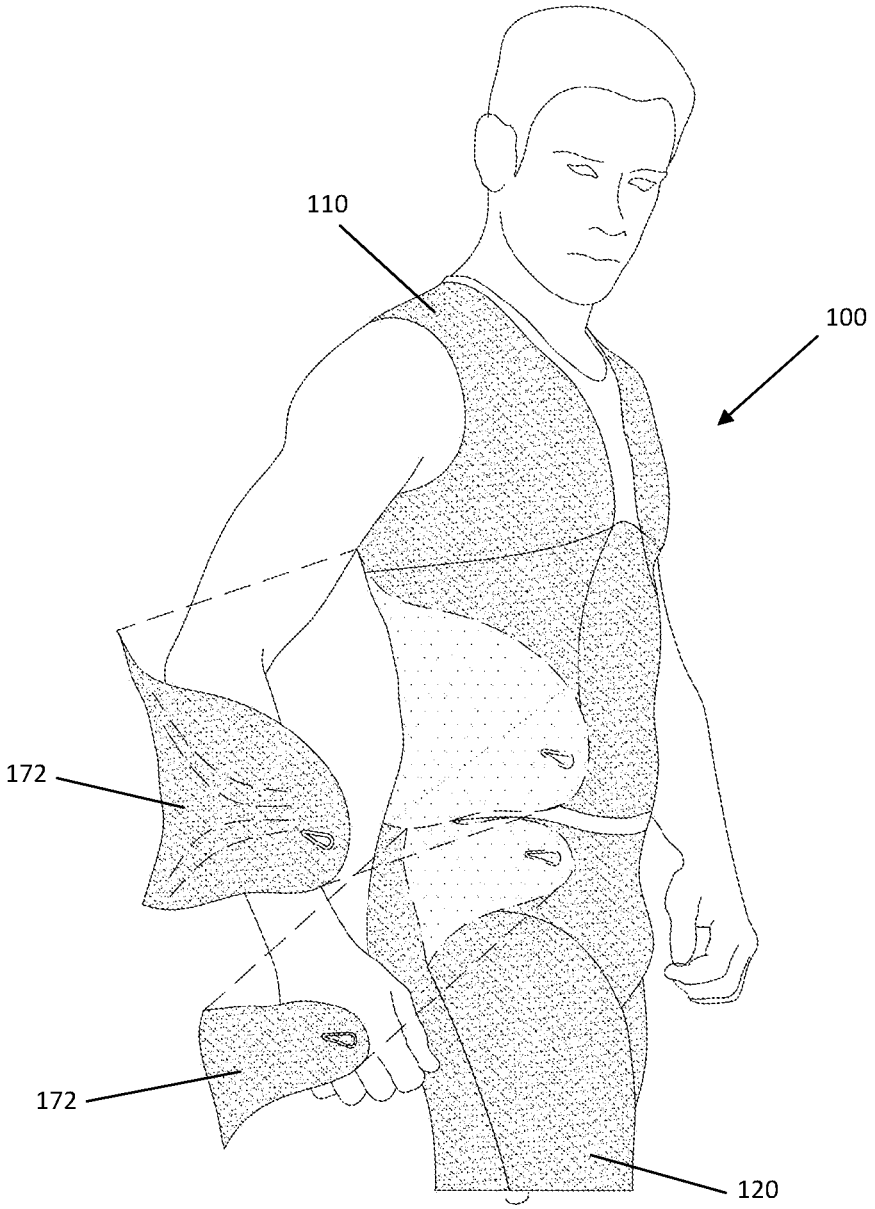
FIG. 13 illustrates a side view of an exemplary exoskeleton system of the present invention, along with a posture support, that is being worn by a wearer.
Figure 14:
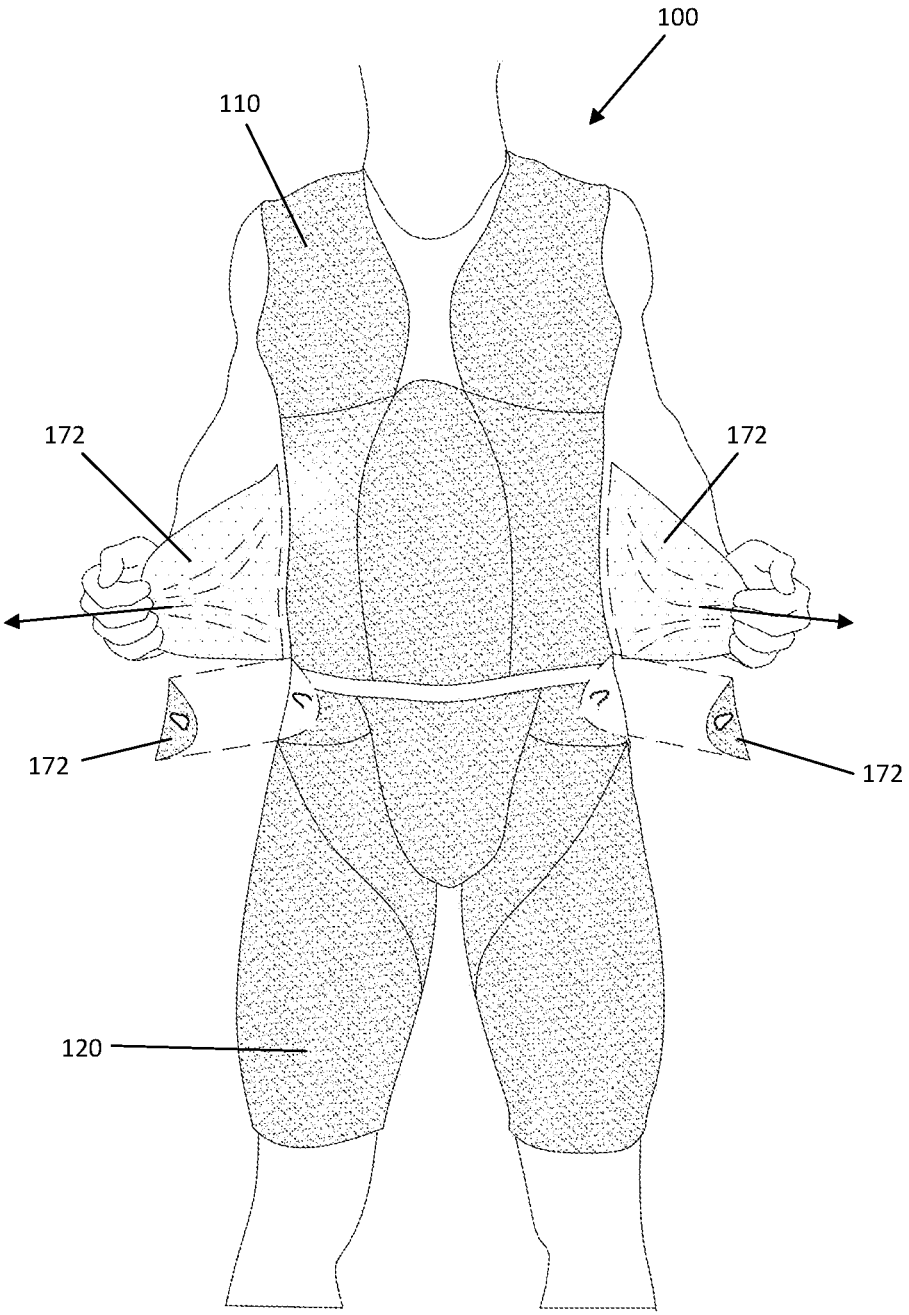
FIG. 14 illustrates a front view of the exoskeleton depicted in FIG. 13, showing the posture support with posture straps being opened.
Figure 15:
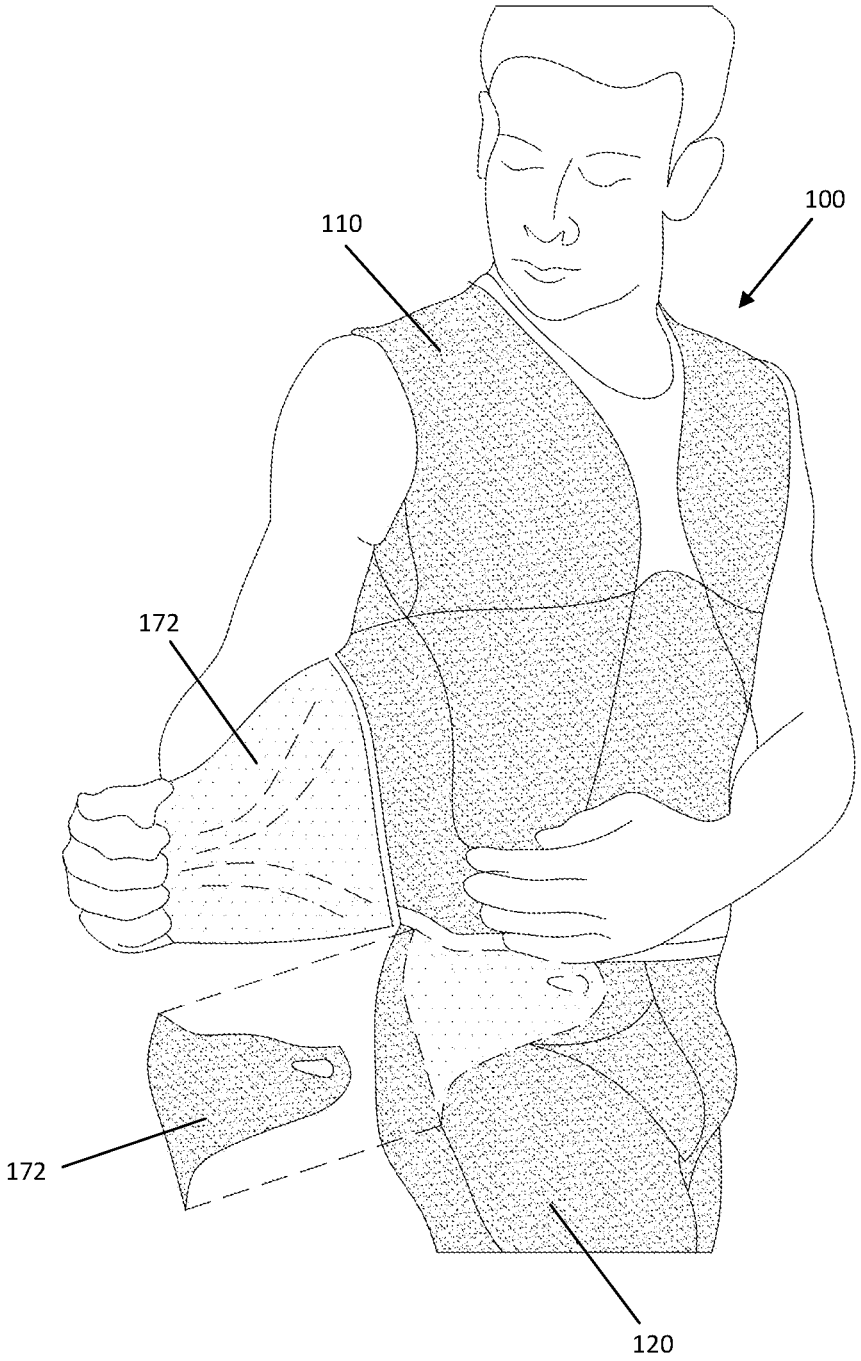
FIG. 15 illustrates a perspective view of the exoskeleton depicted in FIG. 14, showing the posture support with posture straps being opened.
Figure 16:
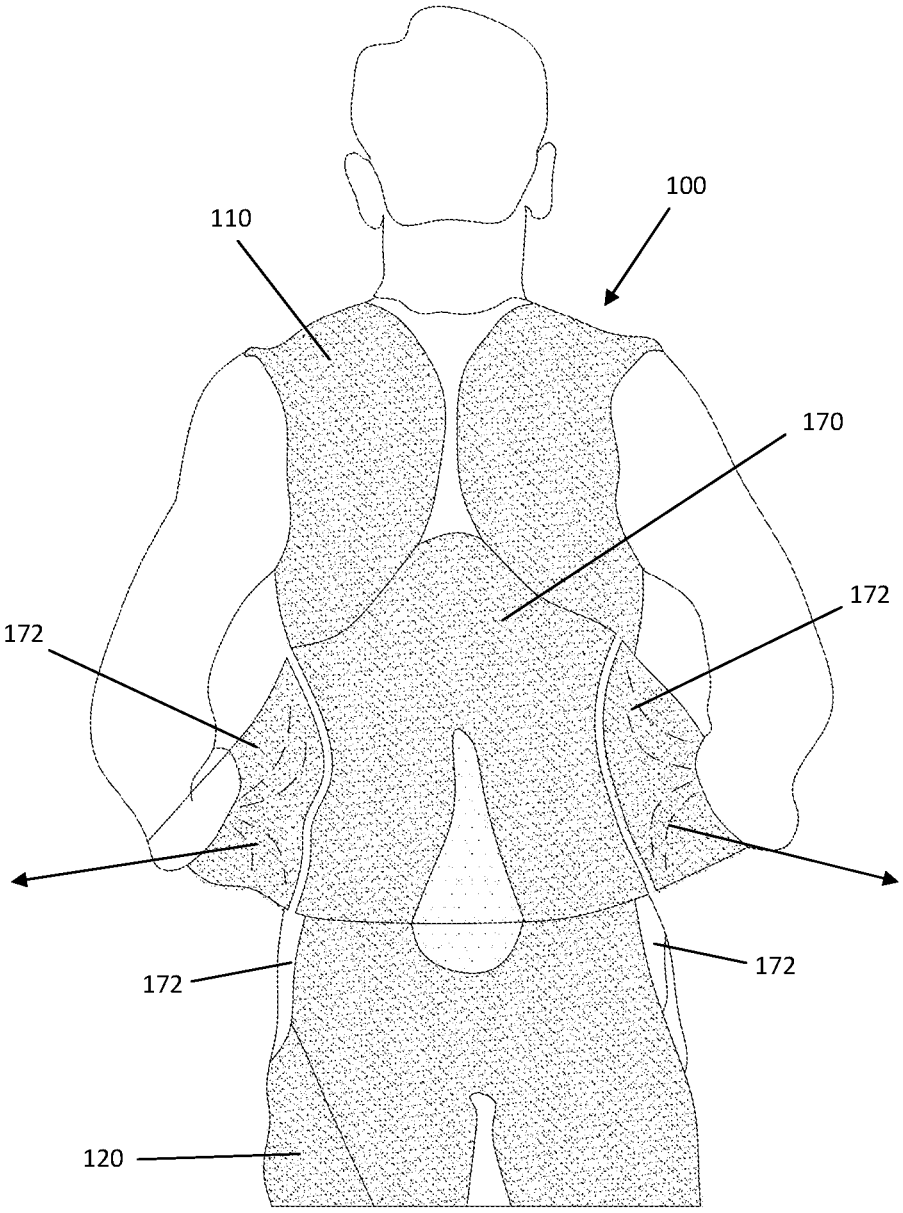
FIG. 16 illustrates a back view of the exoskeleton depicted in FIG. 14, showing the posture support with posture straps being opened.

Referring to FIGS. 1-2, the disclosed invention may be an exoskeleton (100) system comprising at least one garment including a vest (110), pants (120), an upper arm sleeve (130), a lower arm sleeve (140), a thigh sleeve (150), and/or a leg sleeve (160), wherein the garment may be a multilayer construct (e.g., as shown in FIG. 12) that comprises an inner layer (201) of nylon material and an outer layer (203) made of plush material, and an article (300) with attached hook and loop fasteners (301) to be mounted onto the garment by securing the hook and loop fasteners (301) onto any spots or locations of the outer layer (203).

In one embodiment, the complete set of the exoskeleton (100) may be divided into eight different garments to cover different body segments of the wearer. In another embodiment, the complete set of the exoskeleton (100) may be only constituted of 2 different garment pieces, where all of the sleeves may be extended out from the vest and/or pants, respectively. The garments disclosed in the present invention cover almost all of the major muscles parts of the body, namely, the back and rear torso, hip and groin, left and right thigh, left and right leg, left and right upper arm, as well as left and right lower arm.

The materials for fabricating the exoskeleton (100) and/or garments thereof are one of the key factors to deliver the advantages of the present invention. The inner layer (201) of the garments of the present invention may be directly in contact with the wearer's skin. Thus, it should be made of materials that are non-irritating and bio-compatible with human skin to reduce the likelihood of an allergic reaction in the wearer, while the material should also demonstrate good abrasion resistance, good durability, and high resilience, as well. In one embodiment, nylon, or a similar material, may be employed as the material to fabricate the inner layer (201). As the inner layer (201) of the exoskeleton (100) and/or garments thereof is frequently stretched and subjected to friction with human skin, nylon material with the desired properties ensures durability of the disclosed invention for long term utilization. Further, the outer layer (203) of the exoskeleton (100) and/or garments thereof may be derived from a plush material serving as a loop for anchorage of the articles with the hook and loop fasteners, more specifically the hook fasteners like VELCRO™. However, the plush material described herein is not referred to as the loop fasteners of VELCRO™, as VELCRO™ is neither elastic nor stretchable, both of these properties being required in the present invention. With the plush fabric or material as the outer layer (203), the exoskeleton (100) and/or garments thereof not only supports attachments of the articles but also renders the exoskeleton (100) and/or garments thereof to feel smooth and silky. Moreover, the plush material used in the present invention may be non-irritating fabric to further avoid skin irritation.

In accordance with one embodiment, a middle layer (202) made of neoprene or polyurethane may be disposed in between the outer layer (203) and the inner layer (201), e.g., as shown in FIG. 12. It should be appreciated that for the purposes of illustration, the right side of the multilayer construct has been "opened up" to more clearly show the individual layers thereof. More preferably, the outer layer (203) and the inner layer (201) may be joined by the middle layer (202) to form a multilayer structure. The middle layer (202) may be made of a highly pliable, yet mechanically strong, material such as neoprene, polyurethane and/or the like to give the exoskeleton (100) and/or garments thereof the necessary structural integrity. Preferably, the three different layers are stitched together at the peripheral edges or laminated using adhesive, heat, pressure or any combination thereof. Without the middle layer (202), the wearer may find the exoskeleton (100) and/or garments thereof, especially the sleeves, slides up or down or even folds due to the body's movement. The middle layer (202) may also guard the wearer from abrasive injuries and reinforces the body parts. Therapeutic compressive force may be evenly applied to the body parts via the middle layer (202) as well. Having the outer and inner layers covering the middle layer (202), neoprene induced skin irritation may be avoided. The nylon layer deposited in between the skin and the middle layer (202) makes the skin breathable. It is important to note that the exoskeleton (100) and/or garments thereof can be worn in a complete set or a single piece depending upon the wearer's preference. For snug fitting, the exoskeleton (100) and/or garments thereof may be slightly stretched or poised in a contracting state when the exoskeleton (100) and/or garments thereof are worn. Thus, the exoskeleton (100) and/or garments thereof may be compressive to the soft tissues on the body of the wearer upon wearing. As the term "compressive" is used herein, it is meant to refer to the therapeutic compressive force being applied onto the body of the wearer while wearing the exoskeleton (100) and/or garments thereof. It should also be appreciated that the compressive force will exert a pressure in the range of 4-40 mm Hg, depending on the body part and location, onto the body of the wearer while the subject is still wearing the exoskeleton (100) and/or garments thereof.

Figure 3A:
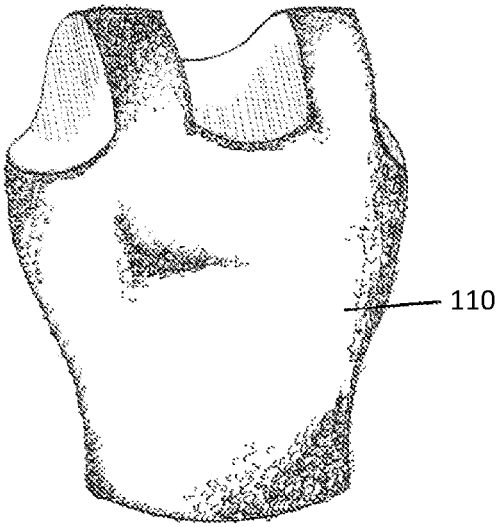
FIG. 3*a* illustrates an embodiment of a sleeveless vest.
Figure 3B:
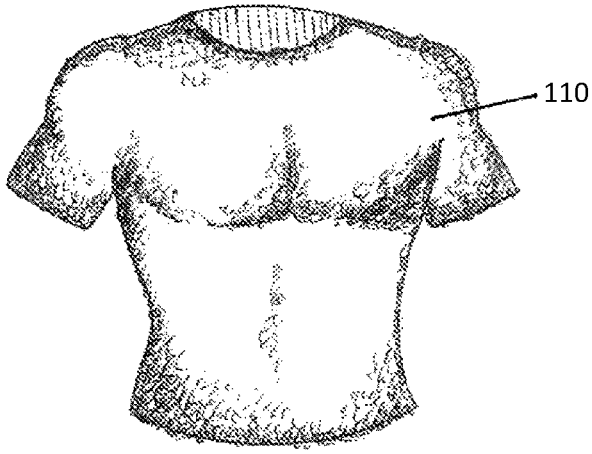
FIG. 3*b* illustrates an embodiment of short sleeve shirt.
Figure 3C:
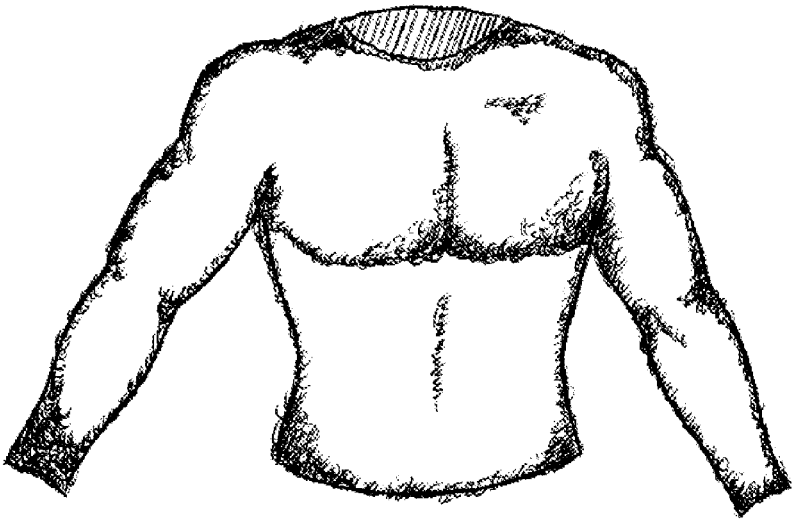
FIG. 3*c* illustrates an embodiment of a long sleeve shirt.

Referring to FIG. 3, different embodiments of the vest/shirt design (110) are shown. FIG. 3*a* shows a sleeveless vest design, FIG. 3*b* shows a short sleeve shirt design, and FIG. 3*c* reveals a long sleeve shirt design that may eliminate the need of using an upper arm sleeve.

Figure 4A:
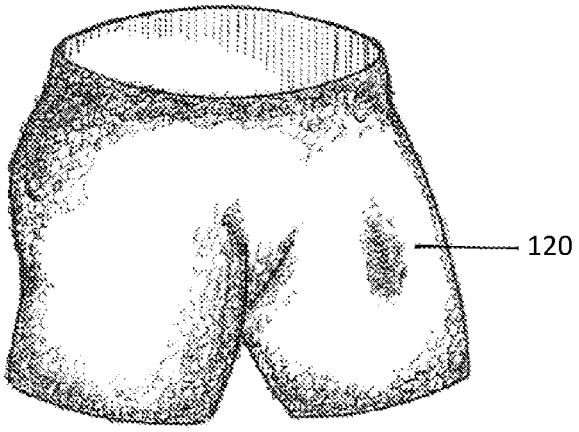
FIG. 4*a* illustrates an embodiment of a pair of shorts.
Figure 4B:
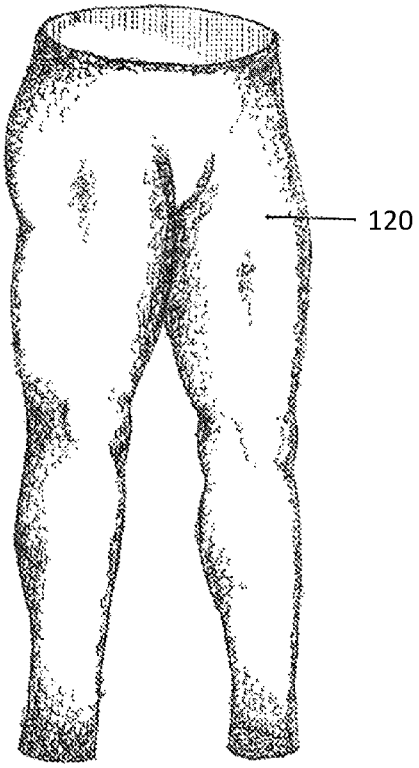
FIG. 4*b* illustrates an embodiment of long pants.
Figure 5:
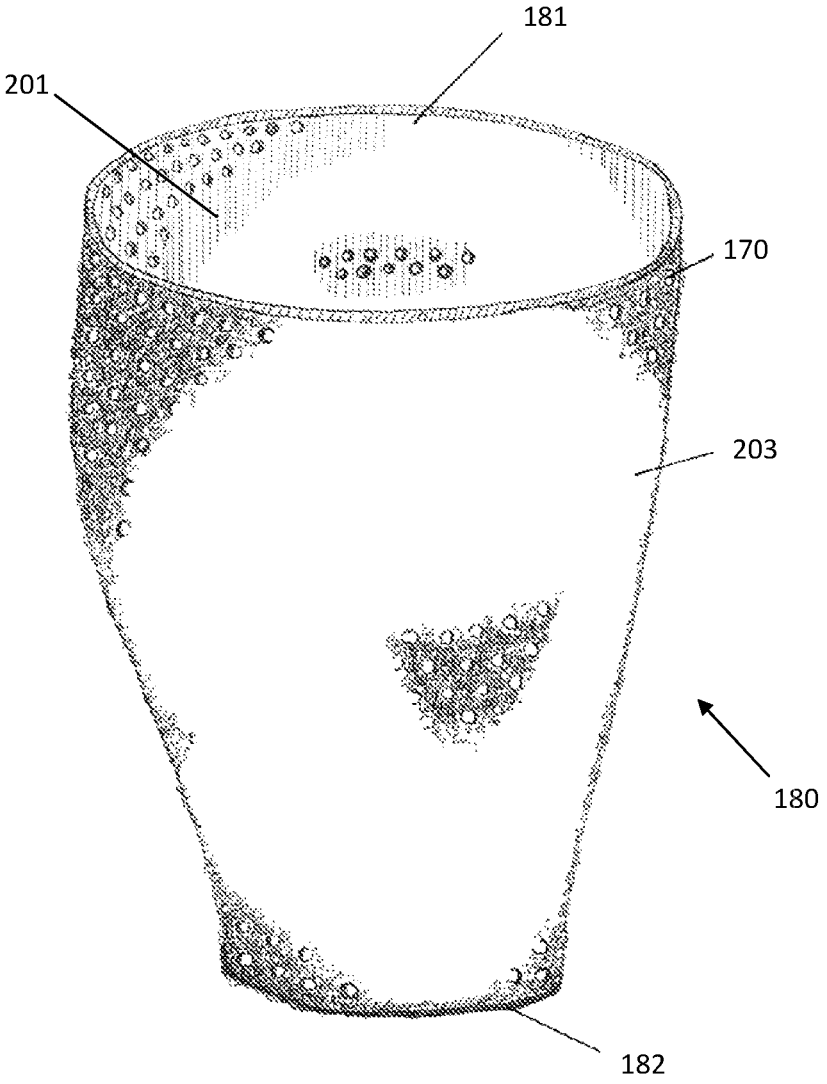
FIG. 5 illustrates an embodiment of a sleeve having perforated through holes formed therein.
Figure 6:
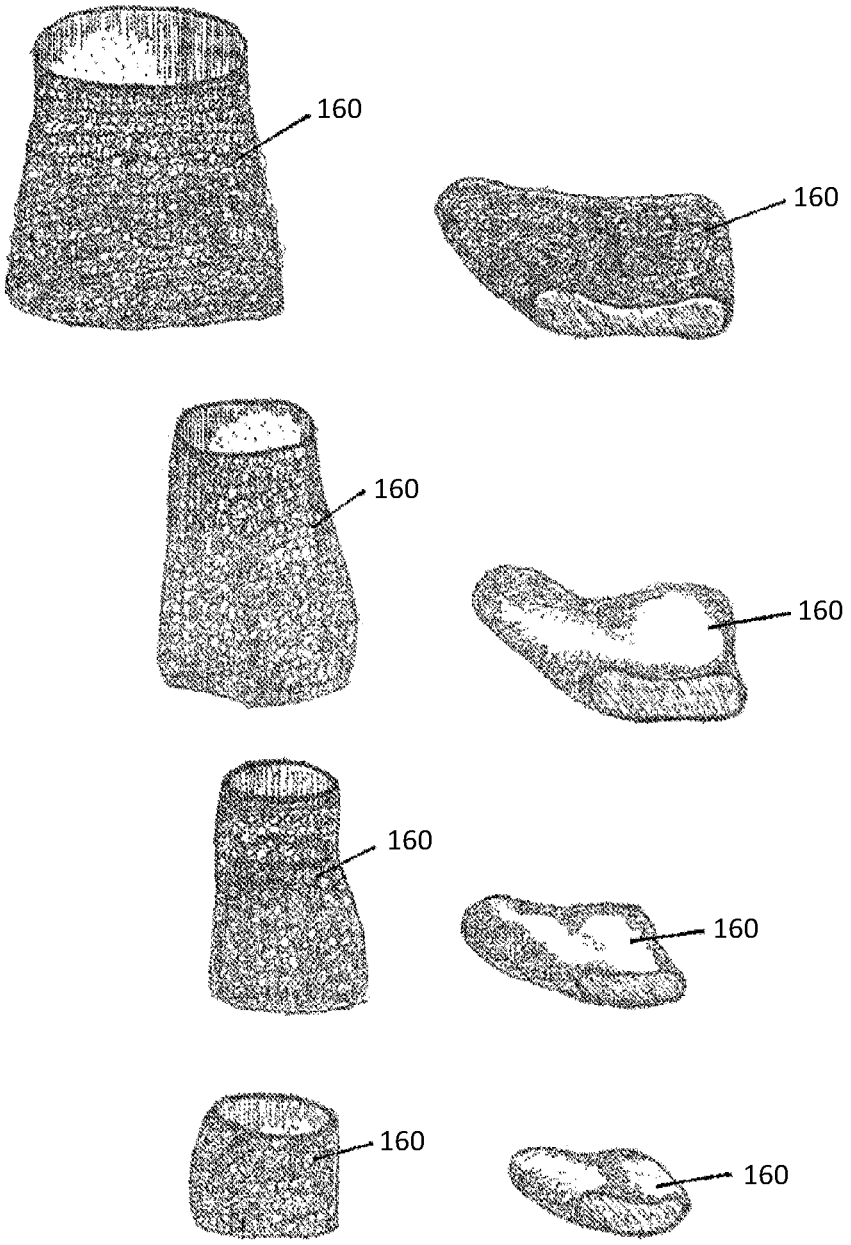
FIG. 6 illustrates various different volumes and sizes of sleeves.

Through the outer plush layer (203), articles can be removably attached anywhere on the front torso, back torso, side torso and the shoulder areas of the wearer onto the vest/shirt of the exoskeleton. Preferably, the vest/shirt may be made to be a seamless single piece for snug fitting. Embodiments can be adapted by the pants (120) as illustrated in FIGS. 4*a* and 4*b*. Shorts shown in FIG. 4*a* may cover the hip, groin and parts of the thigh of the wearer. The pants shown in FIG. 4*b* may extend down to the leg portion covering the whole thigh and leg area such that no thigh sleeve (150) and/or leg sleeve (160) is needed. Further, as illustrated in FIG. 5, is one embodiment of the sleeve (180) where a similar design is generally applied for fabricating different sleeves of various bodies segments, namely, a thigh sleeve (150), a leg sleeve (160), an upper arm sleeve (130) and/or a lower arm sleeve (140). These sleeves may be almost identical to one another besides being different in terms of dimension. Preferably, the sleeve (180) may be fabricated as a single seamless piece. For example, the sleeve (180) may be tubular and having two ends, namely, a first end (181) and a second end (182). The first end (181) may be tapered towards the second end (182) such that the second end (182) is smaller in diameter. For putting on the exoskeleton (100) and/or garments thereof, the sleeve (180) may be orientated in such a way that the first end (181) is wrapped around a proximal end of the limb segment while the second end (182) is located at a distal end of the limb segment. The sleeve of a single limb segment may be produced in various sizes and lengths, e.g., as shown in FIG. 6, to be used by the wearer for different purposes.

To suit the wearer's need, a strap may be fabricated adjacent the second end (182) and/or first end (181) of the sleeve (180) to further tighten the sleeve and avoid slippage of the sleeve on the particular body part. More specifically, the sleeve may have at least one circumferential end to be adjustable in diameter by a strap attached thereon. The strap may run parallel or substantially parallel to a rim of the second end (182) and/or first end (181) when it is pulled. Preferably, the strap may have a free end reaching out from a fixed end connecting the sleeve. A hook fastener or VELCRO™ may be found at the back of the free end to be removably fixed onto the outer surface of the sleeve. Through wrapping and securing the free end around the sleeve, a loose space that occurred in between the skin and the first end or the second end can be tightened up. Other embodiments preferably have the fixed end slightly expanded to connect a larger surface area of the sleeve at length or in a direction perpendicular to the rim of the sleeve. Thus, pulling the strap in this embodiment actually tightens a larger area of the sleeve.

Figure 7:
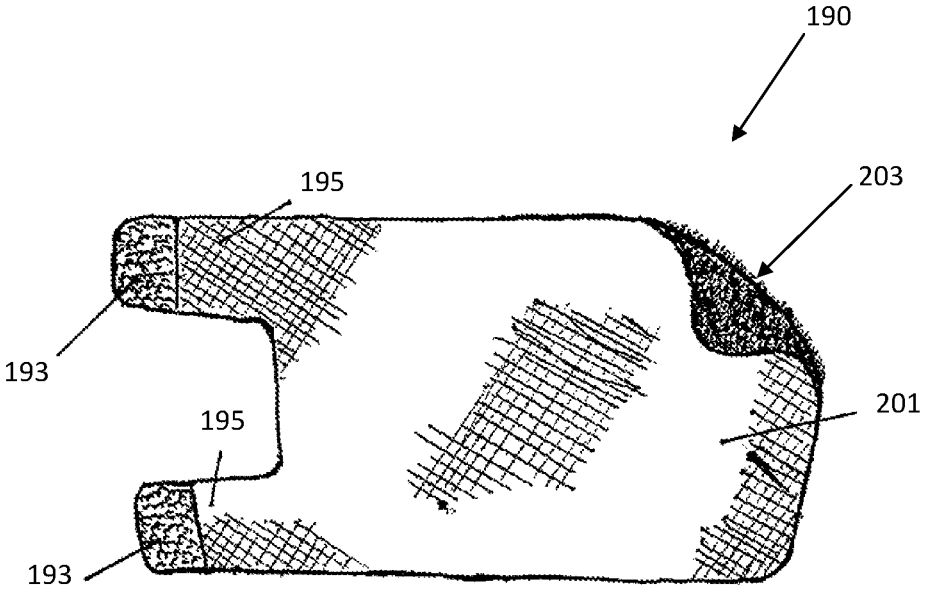
FIG. 7 illustrates an embodiment of a sleeve in an unfastened configuration.
Figure 8:
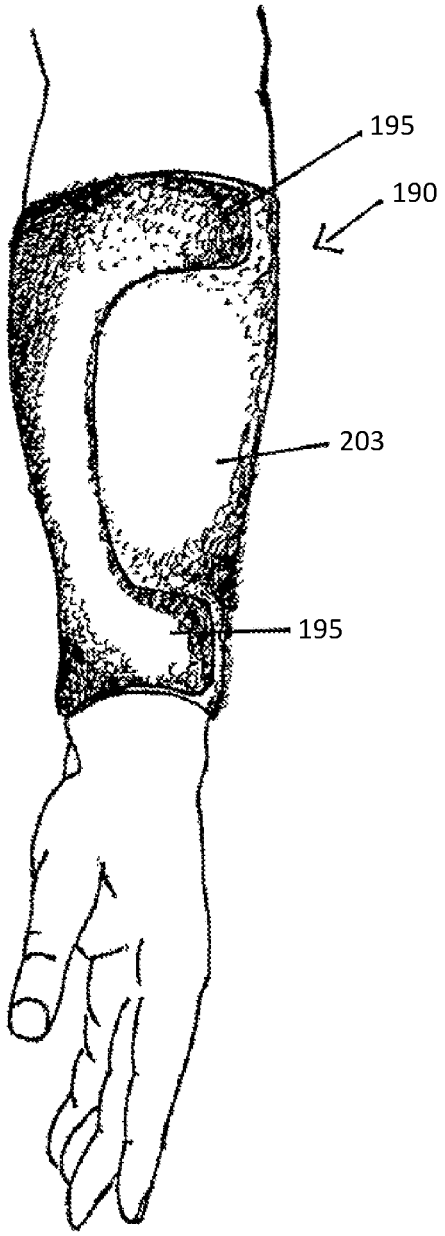
FIG. 8 illustrates the sleeve depicted in FIG. 7 being worn by a wearer.

In accordance with another embodiment, the sleeve (190) may be fabricated using the multilayer construct shown in FIG. 12 as a single piece (190) with one of its short edges equipped with hook fasteners (193) or VELCRO™ at the inner layer (201). Preferably, the short edge may be divided into two different straps (195) (e.g., as illustrated in FIG. 7) such that each strap has a base connected to the sheet and a free end equipped with the hook fasteners (193) or VELCRO™. The sheet wraps around the limb forming a sleeve of the exoskeleton and/or garments thereof. Further, the wearer may pull the straps to tighten the sleeve and anchor the strap onto the outer plush surface. More preferably, the straps (195) may have an expanded base portion connecting the larger surface area of the sheet to effectively fasten the formed sleeve onto the limb upon pulling.

According to another embodiment, the garments of the exoskeleton may be perforated. More specifically, a plurality of through holes may be punctured through the laminated layers. The presence of the through holes may promote air ventilation to the wrapped skin. Each of the through holes may be in the range of 1 to 4 mm in diameter and spaced apart in a predetermined distance in the range of 3 to 10 mm. The through holes may be fabricated smaller in size and stretched to the desired dimension upon wearing. One embodiment may have the whole exoskeleton perforated, yet there are embodiments wherein only a portion of the exoskeleton may be perforated to render the garment more aesthetically attractive. The perforations may make the multi-layer material breathable and comfortable so as to be used in warmer climates. However, in colder climates where heat retention is important, a non-perforated version may be applied where the multi-layered garments help to improve heat retention, allowing warming-up of the muscles and preserving the peripheral/core body temperature of the wearer.

Figure 9:
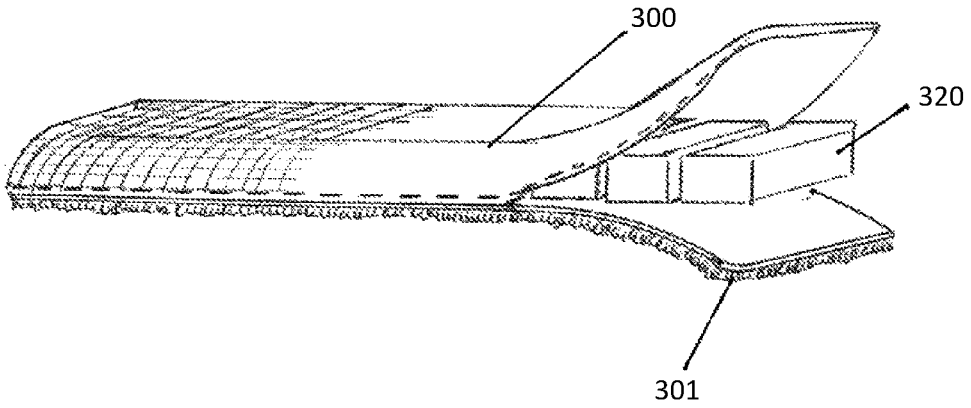
FIG. 9 illustrates an embodiment of an article in the form of an exogenous weight load.
Figure 10:
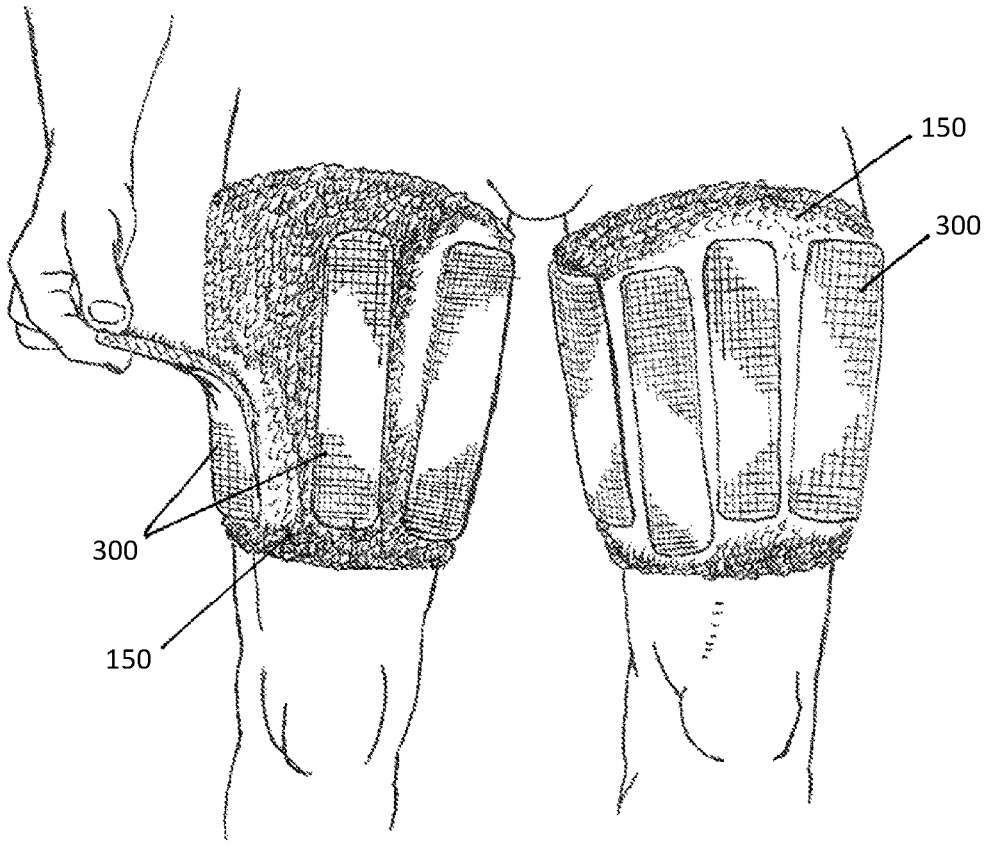
FIG. 10 illustrates the article depicted in FIG. 9 attached onto a thigh sleeve.

As shown in FIG. 9, one embodiment of the article includes one or more exogenous weight loads. The exogenous weight load, in one embodiment, may be a solid bar produced by juxtaposing a plurality of substantially rectangular metal pieces and joining the juxtaposed metal pieces side by side via any known methods, e.g., through welding. Each of the metal pieces may weigh about 1 g to 10 g, depending on its material and fabricated dimensions. Consequently, each solid bar may weigh from 25 g to 200 g. Preferably, the solid bar may have a relatively slim cross-sectional profile so to be able to be attached closely to the wearer's body. The slim design may also reduce possible slippage of the exogenous weight caused by gravitational forces or by being accidentally scratched off by the wearer during vigorous body movement. More preferably, the solid bar may be bendable to allow it to twist or bend ergonomically without hindering body movement. For example, the joint sides of the metal pieces may be indented to render the solid bar bendable. The metal pieces may be comprised of lead, steel, iron or any other alloy materials. Coatings or covers may be applied to fully shield the weight load, followed by having the VELCRO™ or hook fasteners fixed at the back or front of the coating. The coating or cover may be slightly elastic and may be made of any suitable thermosetting polymer, thermoplastic polymers, natural rubber or any combination thereof. Adhesives or any other known means can be used to fix the hook fastener or VELCRO™ fastener onto the back and/or front surfaces of the solid bar or coating. Nevertheless, the exogenous weight load may be embodied in the form of liquid-filled capsules, gel-filled capsules, solid granules such that the exogenous weight load of these forms are preferably coated or packed. Besides weight loads, the same anchorage mechanism may be applicable to other devices which the VELCRO™ or hook fastener adheres onto the devices directly or a coating shields the device followed by having the VELCRO™ attached on the coating. The devices may include, but are not limited to, stopwatches, timers, heart rate monitors, pedometers, motion sensors, force sensors, inertia sensors, acceleration sensors, GPS tracking devices, light reflector strips, hard or soft protective shells or liners, MP3 players or other audio listening devices, cameras or video cameras, phones, wallets and/or the like.

It should be noted that some of the devices such as a heart rate sensor may have to be in direct contact with the skin of the wearer. To accommodate such devices, the exoskeleton and/or garments thereof may have a void area made at specific locations on the garments to permit the necessary contact or the device may be attached along the edge of the garment or even underneath. It is also plausible that the perforations may allow external devices to monitor physiological/physical activity in partial contact with the skin through these perforations. In another embodiment, the external device may be two-pieced, with the anchor attached to the plush surface and a sensory device attached underneath the exoskeleton and/or garments thereof in direct contact with the skin. This could then be linked either through telemetry to the device, sending feedback to it, or directly to the device through magnets and a direct connection link through the perforations or void areas. Nonetheless, the wearer may still position the devices at the preferred locations.

Figure 11A:
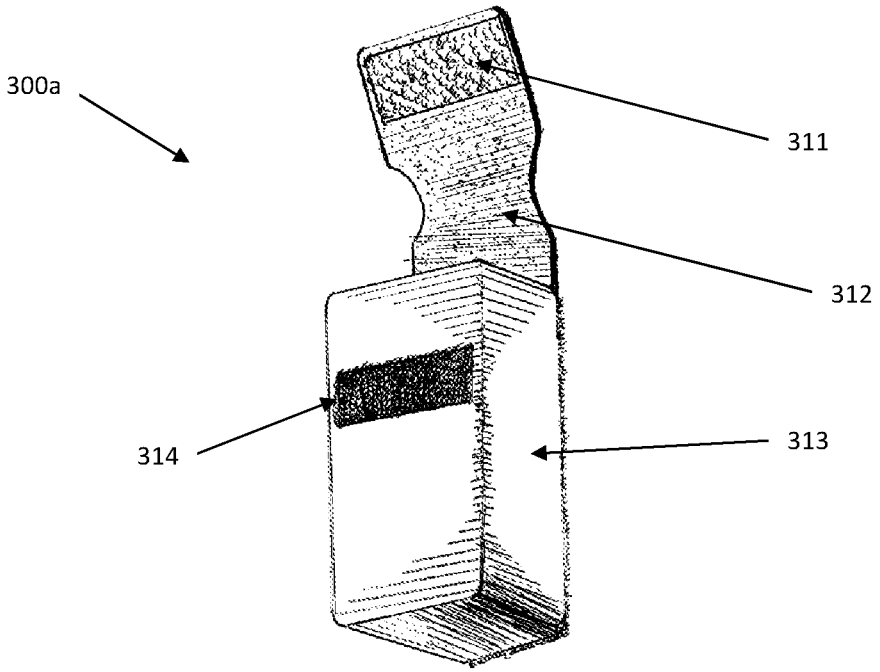
FIG. 11*a* illustrates a front perspective view of a pocket that is useful for holding other devices to be anchored onto the exoskeleton system of the present invention.
Figure 11B:
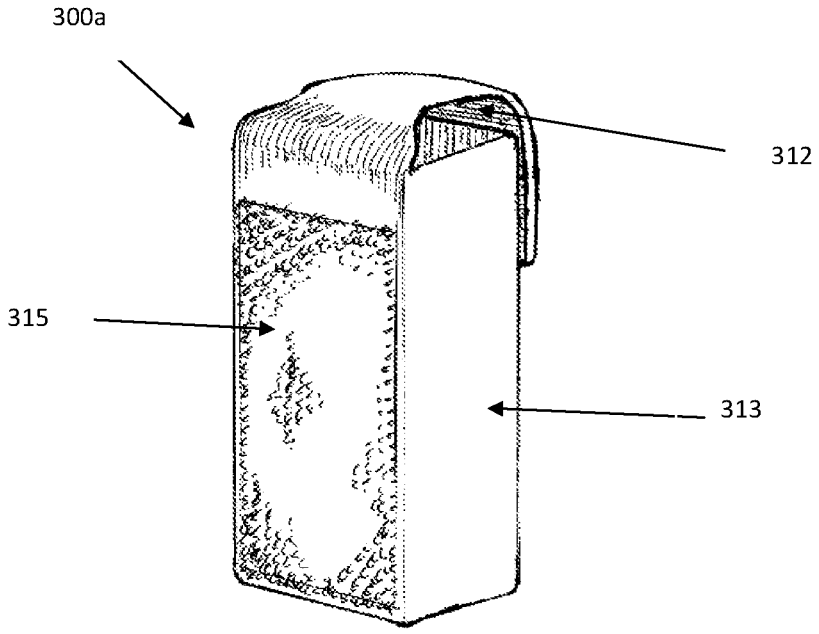
FIG. 11*b* illustrates a back perspective view of a pocket that is useful for holding other devices to be anchored onto the exoskeleton system of the present invention.

In another embodiment, the article may be a pocket (300*a*) of any size as long it can be firmly and neatly attached onto the plush outer surface of the exoskeleton and/or garments thereof. FIGS. 11*a*-11*b* show one embodiment of the pocket (300*a*). The pocket (300*a*) may be comprised of a hollow body (313) having a top opening, and a flap (312) extended out from one of the side surfaces of the hollow body (313) such that the flap (312) may be folded to cover the top opening. Devices to be held by the pocket (300*a*) may be inserted through the top opening, while the flap (312) may cover the top opening. One skilled in the art should appreciate the fact that the opening may not be necessary fabricated on top, but at one of the side surfaces with corresponding flaps. To secure the flap (312) when the pocket is in use, the flap may have a VELCRO™ hook/loop (311) at its inner surface to be attached on the VELCRO™ loop/hook (314) pre-disposed on the outer side surface opposite to the side surface where the flap reached out. Further, hook fasteners (315) may be located at one of the external side surfaces as shown in FIG. 11*b* to anchor the pocket (300*a*) onto the exoskeleton. Devices mentioned herein refer to exogenous weight loads, stopwatches, timers, heart rate monitors, pedometers, motion sensors, force sensors, inertia sensors, acceleration sensors, GPS tracking devices, light reflector strips, hard or soft protective shells or liners, MP3 players or other audio listening devices, cameras or video cameras, phones, wallets and/or the like. These devices may be inserted into the pocket (300*a*) to be anchored onto the outer surface of the exoskeleton, thus eliminating the need, which can be occasionally impractical, to fix the hook fastener or VELCRO™ onto the device, especially the surface of the devices is not favorable for attachment of the VELCRO™. For example, a GPS tracking device may be put into the pocket and attached to a soccer player to allow analysis to be conducted on how the player positioned himself in a game. The exoskeleton of such an embodiment may be aesthetically enhanced too by having various stylish designed pockets.

To tightly secure the exoskeleton and/or garments onto the body, openings on the garments for the wearer to slide in may be preferably slightly narrower in diameter compared to the other parts of the garments to avoid slipping down or up of the worn garments. Preferably, the narrower openings may be achieved by pleating the edges of the opening to form a narrower opening thereto. Possibly, edges of the garments may be seamed to form ducts to provide a firmer grip onto the body to avoid garments slipping. Further embodiment may have an elastic band attached at the edges of the opening to attain the same effect as the pleats mentioned above.

In yet another embodiment, the garment of the exoskeleton may be provided with a posture support (170), as shown in FIG. 13-16. The posture support (170) may include postural straps (172) capable of providing adjustable support to the wearer's trunk and abdomen. Particularly, the straps (172) may provide functional compression support to the core and lumbar region of the wearer. It should also be appreciated that the posture support (170) indicated herein may be capable of providing a functional increase in intra-abdominal pressure during exercise without the same level of restriction on movement and breathing, unlike conventional belts or restrictive back supports that are commercially available. This may be achieved through the novel anatomical shape of the posture supports (170) that follows the body's natural myofascial support system. Specifically, the tapered shape of the strap supports (172) may start at the upper-mid back thus drawing material tension from the thoracic-cervical spine right down to the lumbar-sacral region of the wearer. They (172) may wrap around the side of the torso across the oblique-transverse abdominal region, coming to a focal point over a partial area of the rectus abdominus at the front of the torso at or near the umbilical region. This unique shape and resulting compression that may be applied and adjusted on an individual basis by the wearer, provides the mechanical functional support needed to increase intra-abdominal pressure, while leaving key movement areas of the torso and abdominals uncovered and unrestricted. This allows the user more freedom of movement through the rotational torso region with less mechanical restriction on the main respiratory muscles of the abdominals. Correspondingly, the presence of such adjustable posture support (170) on the garment may be beneficial, especially to athletes or wearers with chronic low back pain or a recent back injury.

The posture support (170), in one embodiment, may be an individual component removably attachable to the garment, particularly to the outer plush layer (203) of the garment, by means of a hook fastener (e.g., VELCRO™). Alternatively, it (170) may be joined to the garment by stitching.

In order to provide compression support to the wearer's body, the posture support (170), as depicted herein, may be fashioned from breathable elastic materials, including the multilayer construct as previously described, with or without modifications. In the case where the multilayer construct is used to fabricate the posture support (170), it should be appreciated that the hook fastener (e.g., VELCRO™) may be attached on the outer surface of the nylon layer, instead of the outer plush layer. Accordingly, the hook fastener (e.g., VELCRO™) on the nylon layer allows the posture support (170) to be attached to the garment.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An exoskeleton system, comprising:

at least one garment selected from the group consisting of a shirt, vest, shorts, pants, an upper arm sleeve, a lower arm sleeve, a thigh sleeve, a leg sleeve, and combinations thereof;

wherein the garment includes a multilayer construct, comprising:

an inner layer of nylon material;

an outer layer substantially fully covered by a plush material; and a middle layer comprised of neoprene or polyurethane, wherein the middle layer is disposed in between the inner layer and the outer layer;

wherein the inner layer, middle layer, outer layer, and plush material are comprised of an elastic material and the garment exerts a compressive force upon wearing;

wherein the compressive force is in a range of 4-40 mm Hg; and an article including attached hook and loop fasteners selectively operable to be mounted onto the garment by securing the hook and loop fasteners onto any portion of the plush material of the outer layer;

wherein the article is operable to receive or secure a device;

wherein the multilayer construct includes perforations extending therethrough for air ventilation, wherein the perforations are in the range of 1 to 4 mm wide and are spaced apart from one another in the range of 3 to 10 mm;

wherein the article is weight-loaded.

2. The exoskeleton system according to claim 1, wherein the article is a pocket.

3. An exoskeleton system, comprising:

at least one garment selected from the group consisting of a shirt, vest, shorts, pants, an upper arm sleeve, a lower arm sleeve, a thigh sleeve, a leg sleeve, and combinations thereof;

wherein the garment includes a multilayer construct, comprising:

an inner layer of nylon material;

an outer layer substantially fully covered by a plush material;

a middle layer comprised of neoprene or polyurethane, wherein the middle layer is disposed in between the inner layer and the outer layer;

wherein the inner layer, middle layer, outer layer, and plush material are comprised of an elastic material and the garment exerts a compressive force upon wearing;

wherein the compressive force is in a range of 4-40 mm Hg; and an article including attached hook and loop fasteners selectively operable to be mounted onto the garment by securing the hook and loop fasteners onto any portion of the plush material of the outer layer;

wherein the article is operable to receive or secure a device;

wherein the multilayer construct includes perforations extending therethrough for air ventilation, wherein the perforations are in the range of 1 to 4 mm wide and are spaced apart from one another in the range of 3 to 10 mm;

wherein the article is weight-loaded;

wherein a strap portion is formed on a terminal portion of the multilayer construct, wherein the strap portion is operable to engage a surface of the outer layer so as to exert an additional compressive force upon wearing.

4. An exoskeleton system, comprising:

at least one garment selected from the group consisting of a shirt, vest, shorts, pants, an upper arm sleeve, a lower arm sleeve, a thigh sleeve, a leg sleeve, and combinations thereof;

wherein the garment includes a multilayer construct, comprising:

an inner layer of nylon material;

an outer layer substantially fully covered by a plush material;

a middle layer comprised of neoprene or polyurethane, wherein the middle layer is disposed in between the inner layer and the outer layer;

wherein the inner layer, middle layer, outer layer, and plush material are comprised of an elastic material and the garment exerts a compressive force upon wearing;

wherein the compressive force is in a range of 4-40 mm Hg; and an article including attached hook and loop fasteners selectively operable to be mounted onto the garment by securing the hook and loop fasteners onto any portion of the plush material of the outer layer;

wherein the article is operable to receive or secure a device;

wherein the multilayer construct includes perforations extending therethrough for air ventilation, wherein the perforations are in the range of 1 to 4 mm wide and are spaced apart from one another in the range of 3 to 10 mm;

wherein the article is weight-loaded;

wherein a posture support portion is formed on a portion of the multilayer construct, wherein the posture support portion includes two free ends operable to engage a surface of the outer layer so as to exert an additional compressive force upon wearing.

* * * * *